United States Patent [19]

Hesse et al.

[11] 4,164,103

[45] Aug. 14, 1979

[54] DEVICE FOR DEBURRING WORKPIECES

[75] Inventors: Jürgen Hesse, Düsseldorf; Peter Grund, Solingen, both of Fed. Rep. of Germany

[73] Assignee: Messer Griesheim GmbH, Frankfurt am Main, Fed. Rep. of Germany

[21] Appl. No.: 842,512

[22] Filed: Oct. 17, 1977

[30] Foreign Application Priority Data

Nov. 2, 1976 [DE] Fed. Rep. of Germany ..... 2650202

[51] Int. Cl.[2] ..... B24B 3/14; B24B 5/06

[52] U.S. Cl. ..... 51/417; 51/425; 51/432; 51/434; 51/426

[58] Field of Search ..... 51/417, 424, 425, 426, 51/431, 432, 433, 434, 439; 62/380, 381

[56] References Cited

U.S. PATENT DOCUMENTS

| | | | |
|---|---|---|---|
| 1,970,762 | 8/1934 | Miksch | 51/417 |
| 3,160,993 | 12/1964 | McCormick | 51/426 X |
| 3,405,481 | 10/1968 | Harper | 51/433 |
| 3,716,947 | 2/1973 | Carpenter | 51/417 |
| 3,824,739 | 7/1974 | Moret | 51/426 X |
| 3,992,899 | 11/1976 | Spahn | 62/381 |
| 4,064,661 | 12/1977 | Maeda | 51/434 X |

*Primary Examiner*—Gary L. Smith

*Attorney, Agent, or Firm*—Connolly and Hutz

[57] ABSTRACT

A device for deburring workpieces of rubber or plastic or the like includes an insulated chamber through which the workpieces traverse and a centrifugal throwing wheel for projected granulated material therefrom and means for embrittling the burrs of the workpieces with the blower having a vertical axis of rotation and projecting the granulated material horizontally therefrom and having a conical deflector in the blasting plane opening downwardly toward the workpieces.

1 Claim, 4 Drawing Figures

A
B
1
2
3
5
7
8
9
10
11
12
13
14
17
18
19
23
24
25
27
28
29
30

DEVICE FOR DEBURRING WORKPIECES

BACKGROUND OF THE INVENTION

The invention is concerned with a device for deburring workpieces, with which the deburring workpieces are blasted by simultaneously spraying an ultra-cold liquefied gas with a granulated material consisting of plastic or metal.

A device for deburring such workpieces which can consist not only of rubber, thermoplastic and duroplastic or thermosetting plastic materials, but also metals, as for example, zinc, is disclosed in German Pat. No. 2,159,839. With this device, the workpieces are rolled around on a rotating plate which is closed in at the periphery and are blasted with granulated material. The deburring of large workpieces in such a device is not possible since the workpieces are not rolled around on a rotating plate nor do they fit into the device at all. Aside from this, the known device allow for only one continuous operation, while precisely with large, especially flattened workpieces, there is a multiple demand for continuous operation methods.

In order to fulfill this demand according to a known device (DT-Gbm No. 7 307 364) the workpieces are carried on a transfer belt through an insulated chamber and blasted from above with granulated material, as well as sprayed with liquid nitrogen. A disadvantage of this device is the high nitrogen consumption, since, in order to pick up and deliver the workpieces, the transfer belt passes from the cold chamber into the warm ambient air, and consequently, cold losses result. Beside this operational disadvantage, the known device is also burdened with a functional deficiency.

Since the workpieces on the belt are not moved, they are blasted with variable strength with the granulated material, because it is not possible to distribute the granulated material coming out of centrifugal fan blowers and injection guns evenly over the transfer belt. This makes for variable deburring of individual workpieces which is, in practice, unsatisfactory.

SUMMARY OF THE INVENTION

The object of this invention is to achieve a device of the latter type which makes possible an even deburring of every shape, thus also of longitudinal and plate profiles, with which a variable deburring is particularly undesirable, and which, furthermore has a low cooling requirement.

Thus, a device for deburring of workpieces—especially of rubber or plastic, according to which the workpieces pass through an insulated chamber on a conveying arrangement, and are struck by high kinetic energy granulated material blasted out of one or more centrifugal fan blowers of or throwing wheels as well as made brittle by addition of a low boiling liquefied gas—was found, which according to the invention is characterized by centrifugal fan blowers with vertical rotation axes which are mounted above the transport arrangement and which blast the granulated material in a horizontal direction, as well as conical deflector collar rings with cone angle openings facing downward, which actually are installed around the centrifugal fan blowers in the blasting plane.

The cone angle of the deflector collar rings amounts to, preferably, 90°. As a result of this, it is achieved that granulated particles wich are blasted out in an essentially horizontal direction onto the deflector collar ring are blasted vertically down onto the workpieces. There results a circular ring as a blasting pattern, in the range of which, the granulated particles impact with practically equal kinetic energy. The cone angle of the deflector collar ring need not, however, absolutely amount to 90°. If it is made, for example, somewhat greater than 90°, the outer diameter of the blasting pattern's circular ring becomes larger than the greater diameter of the deflector collar ring. As a result, one can either blast a wider conveying arrangement or cut off the blasting at the edge of the conveying arrangement where relatively few granulated particles strike.

According to a further advantageous construction of the invention a circular pipe for the liquefied gas, with spray nozzles aimed downward at the workpieces, is mounted onto the lower edge of the deflector collar rings. There is produced as a result of this, an extremely simple deep cooling of the granulated particles immediately before they strike the workpieces. The simultaneous spraying and blasting makes it so that only molding burrs in the core and large volume shaped pieces remain warm and elastic. This is particularly advantageous with a continuous operation in which the workpieces can be delivered still warm, from the molding machine, directly into the deburring apparatus.

The deburring process can, additionally, as a result, be made still more even by designing the conveying arrangement as a vibratory trough with sieve openings. The vibrator administered to such a vibratory trough imparts a dynamic and relative motion to the workpieces which is maintained by an oscillating and turning motion in the transport advance. There results not only the possibility of moving the workpieces on the transport arrangement relative to the transfer direction, but also the advantage of a low cooling medium requirement. Since, namely, the vibratory trough can be mounted completely inside the insulated chamber, and since it does not have to be in contact with the surrounding atmosphere at the workpiece input nor at the workpiece output, the cooling losses remain small. Underneath the vibratory trough, a fine sieve can advantageously be mounted which is rigidly connected with the vibratory trough and serves to separate fine burr and granulated material fragments.

According to an advantageous version of the invention, only two centrifugal fan blowers are installed, since it has been shown, that good and even deburring is thereby achieved.

THE DRAWINGS

FIG. 1 diagrammatically shows a longitudinal sectional view of the inventive device;

DETAILED DESCRIPTION

Figure 1:
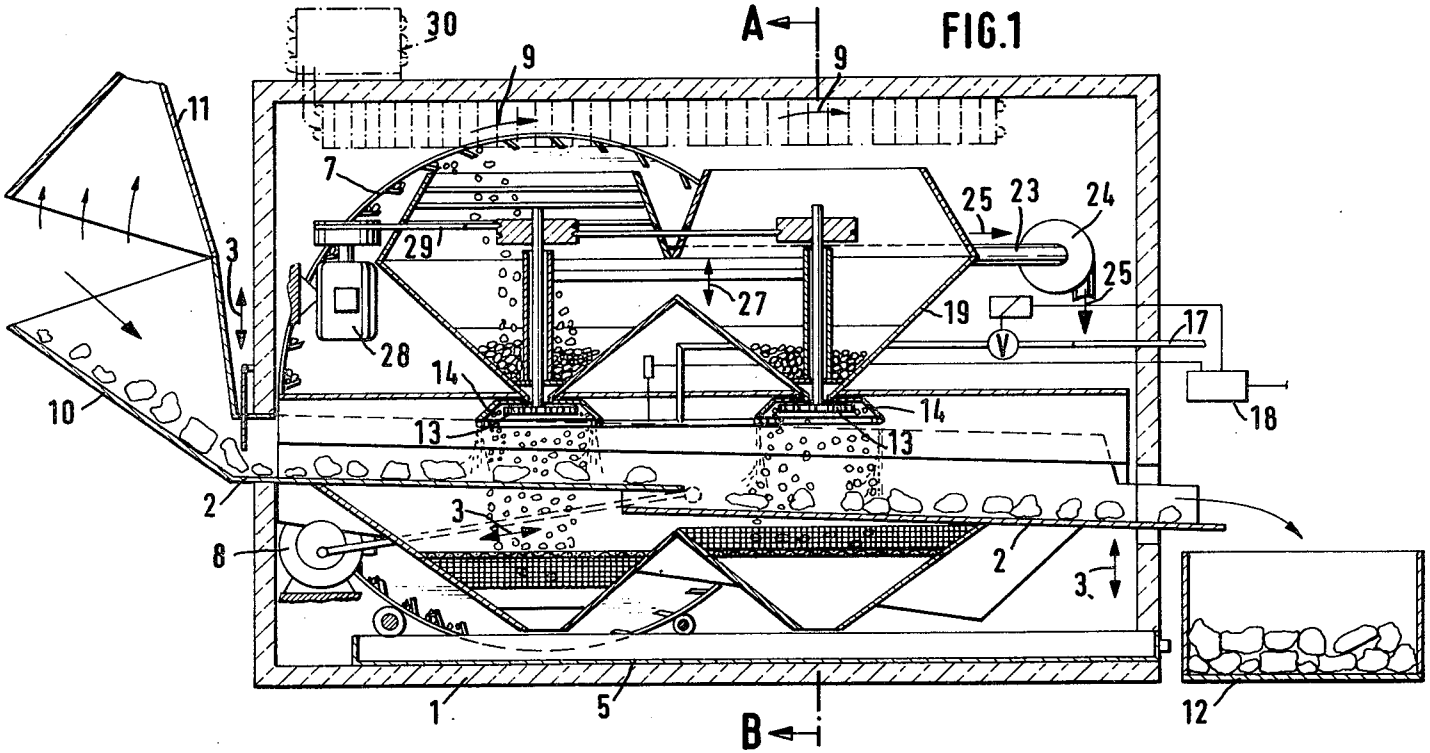
Figure 2:
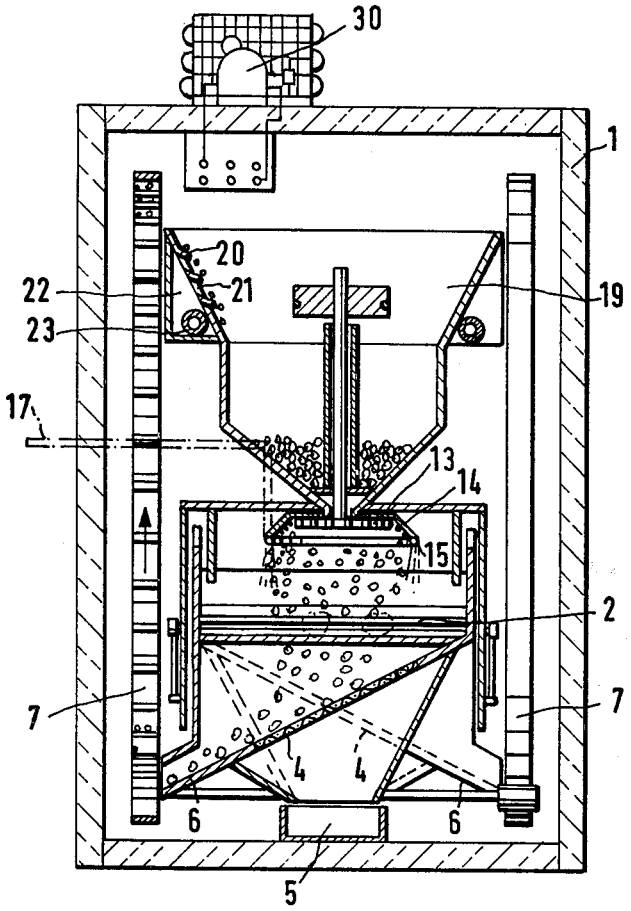
FIG. 2 is a cross sectional view along line A-B from FIG. 1.
Figure 3:
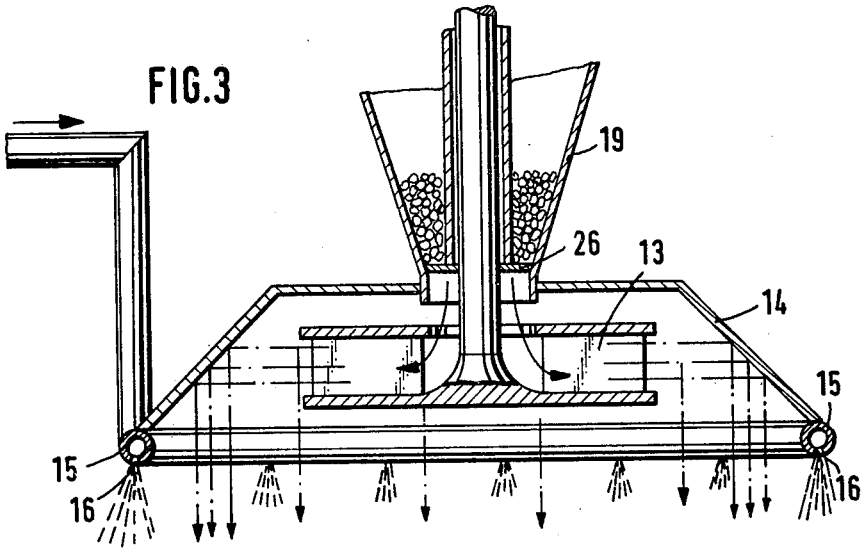
FIG. 3 is a sectional view through a centrifugal blower with a deflector collar ring and ring shaped pipe in accordance with this invention.
Figure 4:
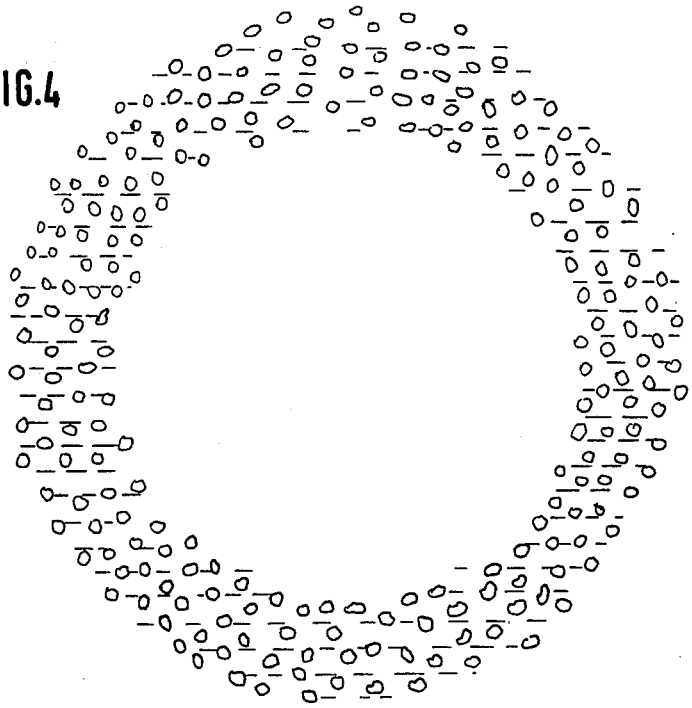
FIG. 4 diagrammatically illustrates a blasting pattern from the invention.

The device is stored in an insulated housing 1 in which is mounted vibratory trough 2. The drive and the direction of motion of the vibratory trough 2 are indicated by the arrow 3. Rigidly connected with the vibratory trough are two fine sieves 4, under which there is a collecting basin 5. The fine sieves 4 discharge into two input devices 6 for two pocket conveyor wheels 7 which are driven by a motor 8. The direction of rotation of the pocket conveyor wheels 7 is indicated by the arrow 9.

The input of the workpieces onto the vibratory trough 2 results by means of the input chute 10 above which there is a vacuum fan 11. The deburred workpieces fall into the collection bin 12.

Above the vibratory trough 2, two centrifugal fan blowers or throwing wheels 13 with vertical rotation axes are mounted. Each centrifugal fan blower is surrounded by a downward opening deflector collar ring 14 in the blasting plane. At the lower edge of each deflector collar ring, there is a circular pipe 15 for liquid nitrogen with downward aimed spray nozzles 16. The supply of nitrogen occurs via the nitrogen supply pipe 17 with the temperature measuring and regulating arrangement 18.

About the axes of each pocket conveyor wheel 7, a silo 19 is mounted, which includes a discharge chute 20 with a suction chamber 22 with suction line 23 and a vacuum fan 24. The flow path of the suctioned air is indicated by the arrow 25. In each silo 19 there is a tap valve 26 which is actuated by an adjusting arrangement symbolically illustrated by the arrow 27. The drive of the centrifugal fan blower 13 occurs by means of a motor 28 and v-belt 29. A cooling unit 30 is installed on the roof of the insulated housing 1.

The functioning of the device is as follows:

The workpieces to be deburred are put into the input chute 10 where they are met with cold nitrogen gas which is sucked by the vacuum fan 11 from the insulated housing 1. A precooling of the workpieces occurs thereby. The workpieces then arrive onto the vibratory trough 2, the feed rate of which is adjustable by means of its inclination. The workpieces slowly drift, via the feed trough and are thereby simultaneously blasted with plastic granules or steel shot and liquid nitrogen. The cooling for the embrittling of the burrs is controlled by means of the injection of the liquid nitrogen. The cooling and blasting range lies under the two centrifugal fan blowers 13 which rotate horizontally and in the same direction. The blasting medium is actually deflected downward by a conical deflector collar ring 14 and forms a blasting pattern in the form of a circle. On each of both deflector collar rings 14, a circular pipe 15 with spray nozzles 16 is attached, which spray liquid nitrogen over the workpieces.

The flow of the blasting medium begins from above out of the silo 19. Upon opening both tap valves 26, the blasting medium flows into the center of the centrifugal fan blower, is accelerated and streams out of it. On the deflector collar ring 14 the trajectory of the blasting medium is deflected downward and to the molded shapes according to the principle "angle of incidence equal angle of reflection" and there blasts off the burrs. By means of the vibration of the vibratory trough, which is provided with sieve openings not illustrated in the diagram, the blasting medium falls downward onto the fine sieves 4 and from there slips into the pocket conveyor wheels 7. On the fine sieve 4, larger granulated particles are separated from finer granulated fragments and burr fragments. The fine granulated burr fragments fall into the collecting basin 5 and are removed from there from time to time. The entire sieving system is subjected to the same vibration as the vibratory trough 2.

Both pocket conveyor wheels 7 are mounted diagonal to one another to the right and left of the vibratory trough and are driven by the same shaft. They carry the granulated material in buckets in a circular path in the same direction upward from below. Up there, the granulated material is dumped into the silos 19. It slides over the discharge chute 20 with slits 21. Air is suctioned through the slits 21 by means of the vacuum chamber 22, the vacuum line 23 and the vacuum fan 24. This thereby removes the dust adhering to the granulated material trickling down the discharge chute. The dusty air is blown into a dust sack by the vacuum fan 24. The granulated material thus forms an inner feed cycle and is at the same time cleaned and cooled immediately before striking the workpieces.

For times of inactivity after use of the device, a cooling unit 30 is provided which holds the atmospheric humidity precipitated by cooling with liquid nitrogen in the frozen state in the housing 1.

With the inventive device, any workpieces made of material which can be made brittle with cooling, especially of rubber, thermoplastic and duroplastic or thermosetting plastics and certain metals, as for example, zinc alloys (zamak) can be processed. Large flattened workpieces and so called skins of smaller workpieces allow themselves to be especially advantageously processed. Large profiles can also be deburred since the input chute 10 is designed to be removable or tiltable.

What is claimed is:

1. In a device for deburring workpieces of rubber or plastic or the like wherein the workpieces traverse an insulated chamber on a transport arrangement and are struck by high kinetic energy blasted granulated material from a centrifugal fan blower, as well as made brittle by the addition of a low boiling liquefied gas, the improvement being said centrifugal fan blower having a vertical rotation axis and being mounted above the transport arrangement to blast the granulated material out in horizontal direction, a conical deflector collar ring having its cone angle opening facing downward being mounted about said centrifugal fan blower in a blasting plane, said transport arrangement comprising a vibratory trough mounted within said chamber, said low boiling liquefied gas being discharged through feed means mounted at said fan blower for the simultaneous cooling and blasting of the workpieces, and said gas feed means being a circular pipe mounted onto the lower edge of said deflector collar ring with spray nozzles for the liquefied gas which are aimed downward onto the workpieces.

* * * * *